US008413792B2

(12) United States Patent
Jegge et al.

(10) Patent No.: US 8,413,792 B2
(45) Date of Patent: Apr. 9, 2013

(54) METHOD AND DEVICE FOR PRODUCING STACKS COMPOSED OF PRINTED PRODUCTS

(75) Inventors: Markus Jegge, Eiken (CH); André Roth, Zofingen (CH)

(73) Assignee: Mueller Martini Holding AG, Hergiswil (CH)

( * ) Notice: Subject to any disclaimer, the term of this patent is extended or adjusted under 35 U.S.C. 154(b) by 246 days.

(21) Appl. No.: 12/938,075

(22) Filed: Nov. 2, 2010

(65) Prior Publication Data

US 2011/0100781 A1 May 5, 2011

(30) Foreign Application Priority Data

Nov. 3, 2009 (EP) ..... 09013814

(51) Int. Cl.
*B65G 57/00* (2006.01)
*B65H 31/04* (2006.01)

(52) U.S. Cl.
USPC ..... 198/605; 414/791; 198/418.4; 198/626.1

(58) Field of Classification Search ..... 198/418.4, 198/418.9, 605, 607, 626.1; 414/791.1, 792.7, 414/794.4, 790.4, 790.5, 790.6, 790.9, 791; 271/69, 477, 190, 191, 198, 200, 201, 213, 271/214, 215, 216, 220, 221, 3.12
See application file for complete search history.

(56) References Cited

U.S. PATENT DOCUMENTS

| | | | | |
|---|---|---|---|---|
| 5,409,207 | A * | 4/1995 | Freeman | 271/181 |
| 6,003,860 | A * | 12/1999 | von Aesch et al. | 271/214 |
| 6,951,333 | B2 * | 10/2005 | Gosslinghoff | 271/177 |
| 2008/0230981 | A1 * | 9/2008 | Iwami et al. | 271/153 |

FOREIGN PATENT DOCUMENTS

| | | | |
|---|---|---|---|
| DE | 3513354 | A1 | 1/1986 |
| DE | 4023234 | A1 | 2/1991 |
| EP | 0623542 | A1 | 11/1994 |
| EP | 0741101 | A2 | 11/1996 |
| EP | 0872443 | A2 | 10/1998 |
| EP | 1350750 | A1 | 10/2003 |
| EP | 1405809 | A1 | 4/2004 |
| EP | 1950159 | A1 | 7/2008 |
| FR | 2824547 | A1 | 11/2002 |

OTHER PUBLICATIONS

European Search Report dated Apr. 19, 2010, directed to counterpart application No. 09013814.0 (6 pages).

* cited by examiner

*Primary Examiner* — Leslie A Nicholson, III
(74) *Attorney, Agent, or Firm* — Venable LLP; Robert Kinberg

(57) ABSTRACT

A method and device are provided to produce stacks composed of printed products. Printed products are supplied substantially vertically and in an overlapping flow with the aid of a first conveying device continuously to an essentially horizontally extending stack support. A stack is formed at the stack support, where the printed products are at least approximately lined up in an upright position. The stack on the stack support is transported with a second conveying device moving at a forward-feed speed and in a forward-feed direction. The stack is supported along a leading stack end against a support device that also moves in the forward-feed direction. A third conveyor acts upon a region of a lower edge of at least one printed product, which impacts the stack support, to move the at least one printed product in the forward-feed direction of the stack with a speed that corresponds at least to the forward-feed speed of the stack.

14 Claims, 5 Drawing Sheets

METHOD AND DEVICE FOR PRODUCING STACKS COMPOSED OF PRINTED PRODUCTS

CROSS-REFERENCE TO RELATED APPLICATION

This application claims the priority of European Patent Application No. 09013814.0, filed on Nov. 3, 2009, the subject matter of which is incorporated herein by reference.

BACKGROUND OF THE INVENTION

The invention relates to methods and devices for producing stacks composed of printed products which are supplied continuously while essentially positioned upright with the aid of a first conveying device and in an overlapping flow to a substantially horizontally extending stack support and which form a stack while lined up at least approximately positioned upright. The stack that is positioned on the stack support is conveyed with the aid of a second conveying device in a forward-feed direction and at a forward-moving speed and, in the process, is supported along one leading stack end against a supporting device that also moves along.

A method and device for producing stacks composed of print products are generally disclosed in the art, for example in European patent documents EP 0623542, EP 0872443 and EP 1405809. Stacks of this type, also called bundles, are held together with the aid of end boards and strapping and have long proven themselves in the process of removing printed sheets from printing presses and preparing them for the further processing.

Stacking thick printed sheets, for example sheets containing 100 or more pages, often causes a comparatively strong spreading out or expansion of the sheets towards end of stack, which are positioned on their backs during the conveying for the stack formation. In particular with folded printed products where the folding edges respectively form the backs, this can make the stack formation considerably more difficult. In addition, these printed products can be damaged during the stack formation because of the comparatively high friction.

An arrangement said to be especially suitable for such printed products is disclosed in European patent document EP 1950159, in particular for products that are stitched or stapled along the fold, wherein these printed products can include newspapers, magazines or brochures. To simplify the stack forming process, it is proposed to divide the stack into a plurality of stack sections and to arrange these sections offset against each other. For the offset arrangement of a stack, a displacement device is required which engages in the stack support and is embodied, for example, as graduated conveying belt. A stack composed of offset stack sections, however, requires considerably more space, and the production thereof is clearly more involved than that of a traditional stack.

The method according to the European patent document EP 1350750 is intended to facilitate the forming stacks composed of printed products. For this, the sheet-metal guides arranged in the region above the area where the printed products arrive on the stack support are respectively provided with a region that projects in stacking direction and which functions to redirect the printed products into stacking direction during the feeding to the stack support. This is operative to increase the inherent stability of the printed products during the intake as well as to provide more space for the newly supplied printed products. However, this method has the disadvantage that the friction is increased between the printed products, thus also increasing the risk of damage to the products and/or blurring of the print color. A compacting device for compacting the downstream-directed portion of the stack is furthermore arranged in stacking direction at a distance to the area of impact for the printed products, which acts to accelerate two opposite-arranged edge regions of the of the printed products in stacking direction. A brush roller is also arranged, according to one embodiment, on both sides above the upstream, non-compressed portion of the stack which promotes the conveying.

SUMMARY

It is therefore an object of the present invention to create a method, as well as a device for realizing said method, that may permit a particularly easy, secure and careful stack formation, but nevertheless also a high output.

The above and other objects are accomplished according to one aspect of the invention wherein there is provided a method for producing stacks composed of printed products which, in one embodiment, includes supplying the printed products substantially vertically and in an overlapping flow with the aid of a first conveying device continuously to an essentially horizontally extending stack support; forming a stack at the stack support, wherein the printed products are at least approximately lined up in an upright position; transporting the stack on the stack support with a second conveying device moving at a forward-feed speed and in a forward-feed direction, wherein the stack is supported along a leading stack end against a support device that also moves in the forward-feed direction; and acting upon a region of a lower edge of at least one printed product, which impacts the stack support, using a third conveying device to move the at least one printed product in the forward-feed direction of the stack with a speed that corresponds at least to the forward-feed speed of the stack.

The application furthermore relates to a device for producing stacks of printed products which, according to one embodiment, includes a horizontally extending stack support; a first conveying device to supply the printed products continuously in an overlapping flow and essentially vertically to the stack support, wherein the stack support comprises an area of impact in which a lower edge of the printed products impact with the stack support before forming a stack while positioned upright and lined up on the stack support; a support device; a second conveying device adapted to move the stack in a forward-feed direction against the support device, wherein the support device supports the stack along a leading stack end; and a third conveying device that is adapted to act upon the lower edge of the printed products that arrive on the stack support in the area of impact to move the printed products in the forward-feed direction toward the stack.

According to one embodiment, at least one printed product that may impact with its lower edge with the stack support may be acted upon in the region of its lower edge by a third conveying device and may be moved in stack forward-moving direction with a speed that corresponds at least to the forward-moving speed of the stack. The third conveying device thus may act upon the region of the lower edge of the printed product, thereby pushing it toward the stack. As a result, additional space may be created for the respectively next printed product in the region of the lower edge, for example at the underside of the stack of printed products. In this way, the friction between adjacently stacked printed products can be reduced considerably, especially in the back area. As a result, the stack forming may be simplified and interferences, as well as damage, to the printed products can for the most part be avoided.

According to another embodiment, when producing stacks of printed products, it may be possible to effectively prevent so-called "loop-forming," where the outer sides of a folded printed product may be pushed away by the following printed product. Loop-formed printed products and/or printed sheets, which may be pushed one into the other, may not be processed further and may have to be transferred out. Experiments have shown that loop forming can also be prevented effectively even with comparatively thick printed products, for example products having 100 and more pages.

According to a further embodiment, the respective printed product may be acted upon either as a result of friction or a force applied in the region of its lower edge. A sufficient force transfer can thus be realized for displacing the region of the lower edge of the respective printed product in the direction of the stack.

Yet another embodiment provides that each printed product that arrives on the stack support may be acted upon by the third conveying device in the region of its lower edge. The printed products in the already formed stack can subsequently be transported as usual on the stack support, for example with belts and other methods disclosed in the art.

According to one embodiment, the third conveying device may act upon the printed product in the lower edge region, for example along a back side of the printed product that faces away from the forming stack. This lower edge region can therefore be moved with the predetermined speed against the stack, for example in a forward-feed direction. The operation may be particularly easy and secure if, according to a further embodiment, the third conveying device may act with a pusher element in the lower edge region upon the printed product to push the printed product toward the forming stack. A pusher element of this type can be embodied, for example, as a tooth or a finger or even a plurality of fingers, wherein an endless conveying element with a plurality of pusher elements may be particularly suitable for this.

According to one embodiment, the aforementioned endlessly circulating conveying element can be realized particularly easily and securely as well as cost-effectively with a toothed belt. A driven and adjustable toothed belt of this type may be provided with a plurality of teeth on the outside, wherein respectively one of these teeth acts upon the lower edge of a printed product and pushes it toward the stack. The toothed belt can be replaced, for example, for the adaptation to different printed products. Alternatively, the endlessly circulating conveying element can also be realized with a flat belt.

According to another embodiment, at least two endlessly circulating elements may be arranged at a distance to each other, wherein an embodiment with a particularly wide, endlessly circulating conveying element or with more than two such conveying elements may be possible as well. These conveying elements are motor-driven, for example, and may be controlled such that the region of the lower edge is moved with an appropriate speed. Suitable drives and control units are disclosed in the art.

BRIEF DESCRIPTION OF THE DRAWINGS

The present invention will be more readily understood from the following detailed description when read in conjunction with the accompanying drawings, in which.

DETAILED DESCRIPTION

Figure 1:
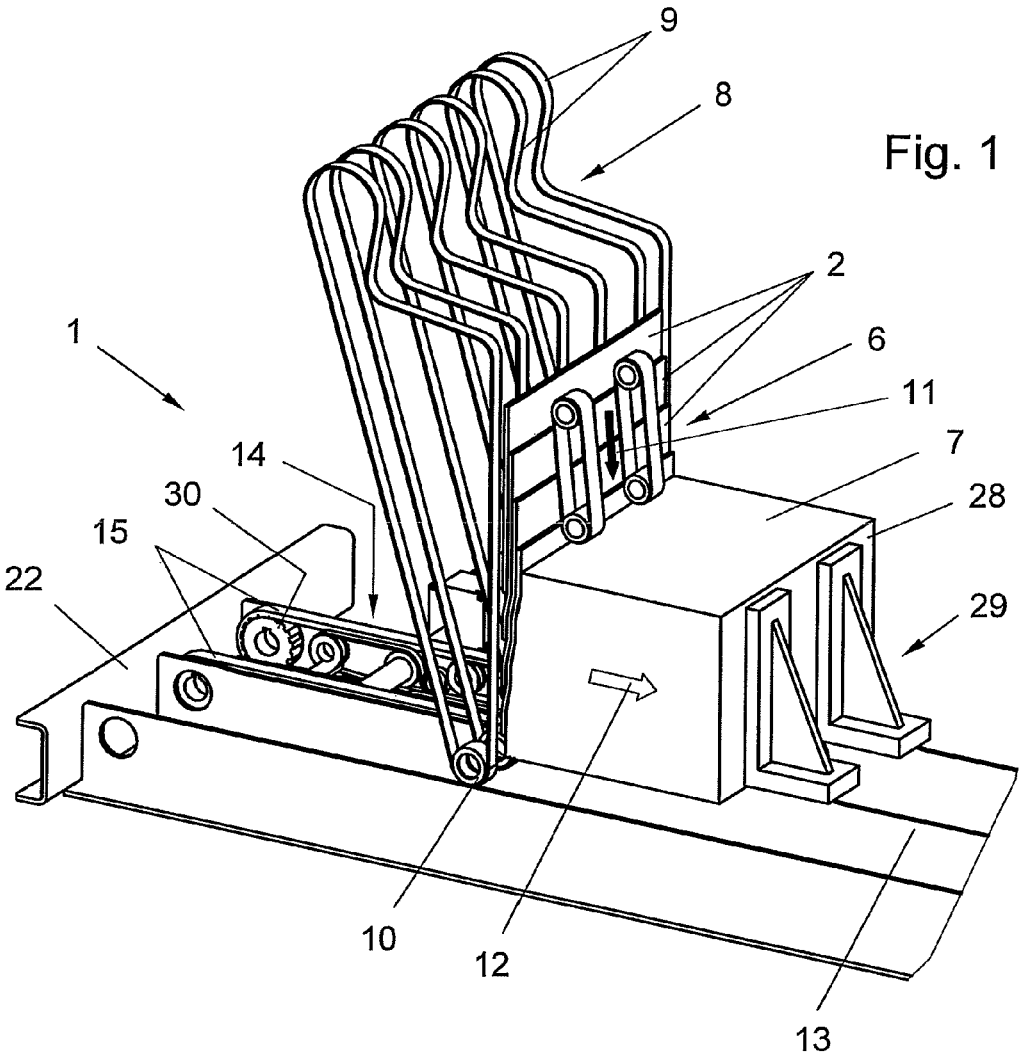
FIG. 1 is a three-dimensional partial view of the device according to one embodiment of the invention.

According to the embodiment shown in FIG. 1, the device 1 comprises a first conveying device 8 with conveying belts 9 that are guided over deflection rolls 10, for supplying printed products 2 in an overlapping flow 6 in an essentially vertical conveying direction 11 to a stack support 13. On the stack support 13, the printed products 2 are placed one against the other to form a stack 7 and are pushed forward with the aid of a second conveying device 14, in an essentially horizontal forward-feed direction 12. The stack 7 is supported along a leading stack end 28 on a supporting device 29, which is known in the art.

Figure 3:
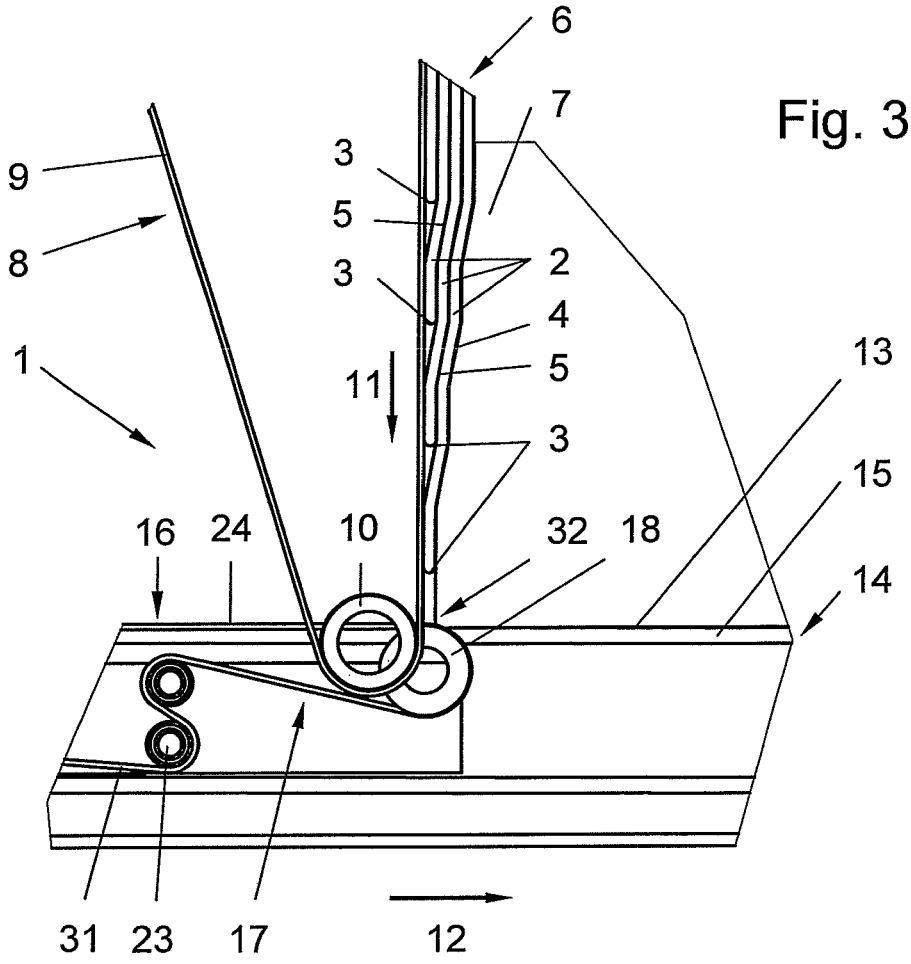
FIG. 3 is a partial view from the side of the device shown in FIG. 1.
Figure 4:
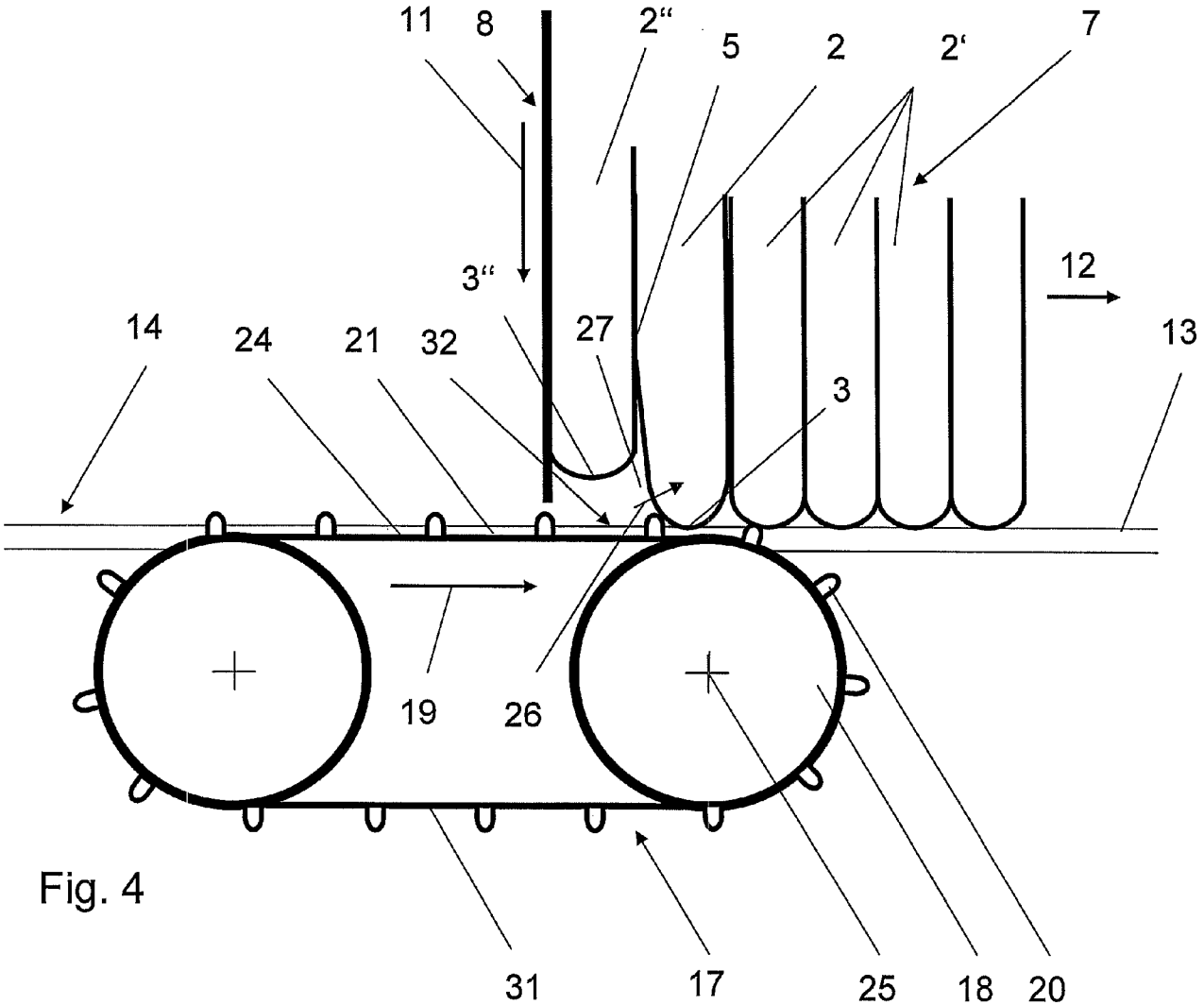
FIG. 4 is an enlarged partial view of components of the device according to an embodiment of the invention.

The printed products 2 can be, for example, but not limited to, newspapers, magazines, booklets or printed sheets that are folded once, several times, or also stitched. These products respectively have a lower edge 3 that leads in a conveying direction 11, a front side 4 that points in the forward-movement direction 12, as well as an opposite-directed back side 5, as shown in FIGS. 3 and 4. If the printed products 2 are provided with a fold, this fold forms the leading, lower edge 3. The folded printed products 2 can respectively be open along the remaining sides. As a result of the fold, the printed products 2 are somewhat thicker in the region of the lower edge 3 than above the edge 3, which is the case even if the fold has been compressed. The printed products 2 can have comparatively many pages, for example 100 and more pages.

In order to form the stack 7, the printed products 2 are first transported vertically and then horizontally and, in the process, are deflected by approximately 90° from the transporting direction 11 to the forward-feed direction 12. A specific stack pressure is maintained in the stack 7, wherein this pressure ensures that the stack 7 is stable and can be strapped during a later method step, as disclosed, for example, in the above-mentioned prior art.

For the forward movement of the stack 7, two forward-feed belts 15 that are spaced apart horizontally are arranged essentially parallel to each other inside a machine frame 22 of the device 1, wherein these belts form the second conveying device 14 together with a drive that is shown herein only as a drive gear 30. The formed stack 7 rests on this conveying device 14 and is conveyed in forward-feed direction 12 with a specific speed against the supporting device 29. The forward-feed speed can be controlled with the aid of the second conveying device 14. Of course, more than two forward-feed belts 15 can be used and a single forward-feed belt 15 is conceivable as well.

Figure 2:
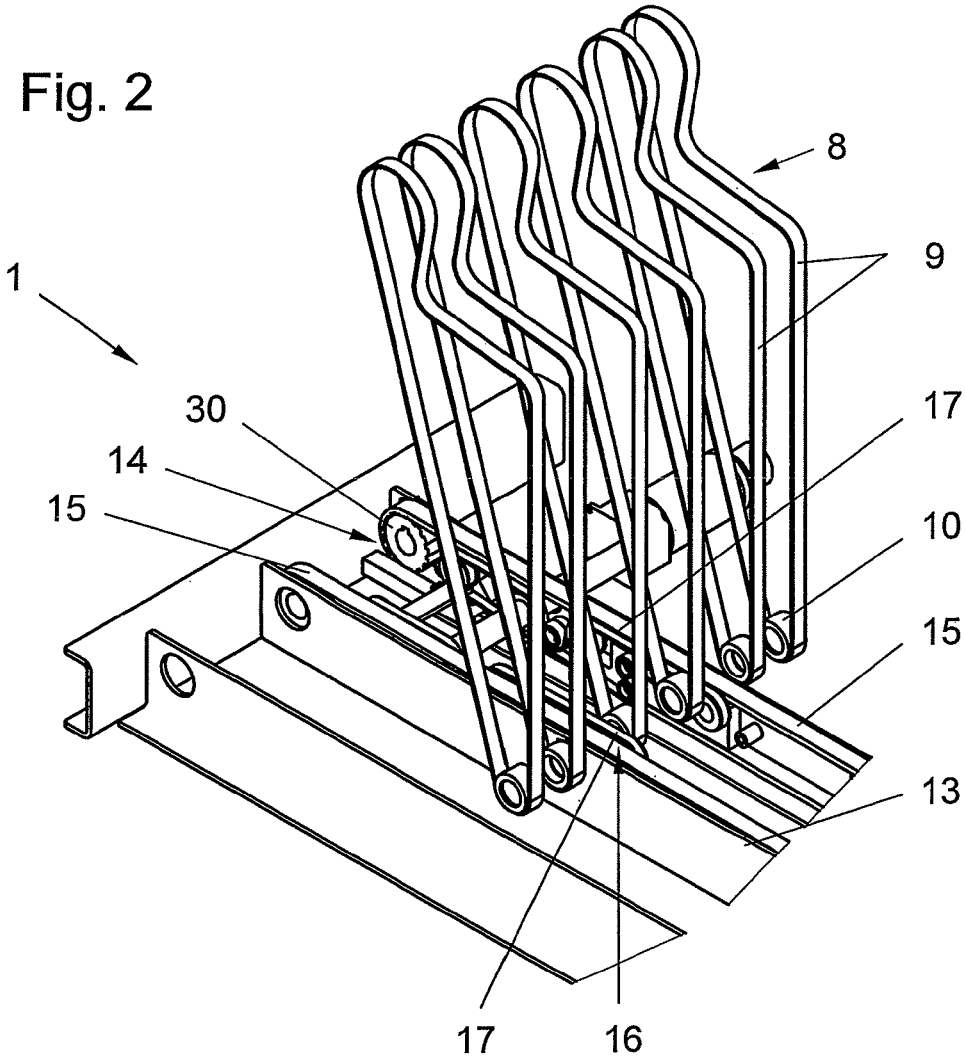
FIG. 2 is a view according to FIG. 1, but without the stack and the overlapping flow, according to one embodiment of the invention.
Figure 5:
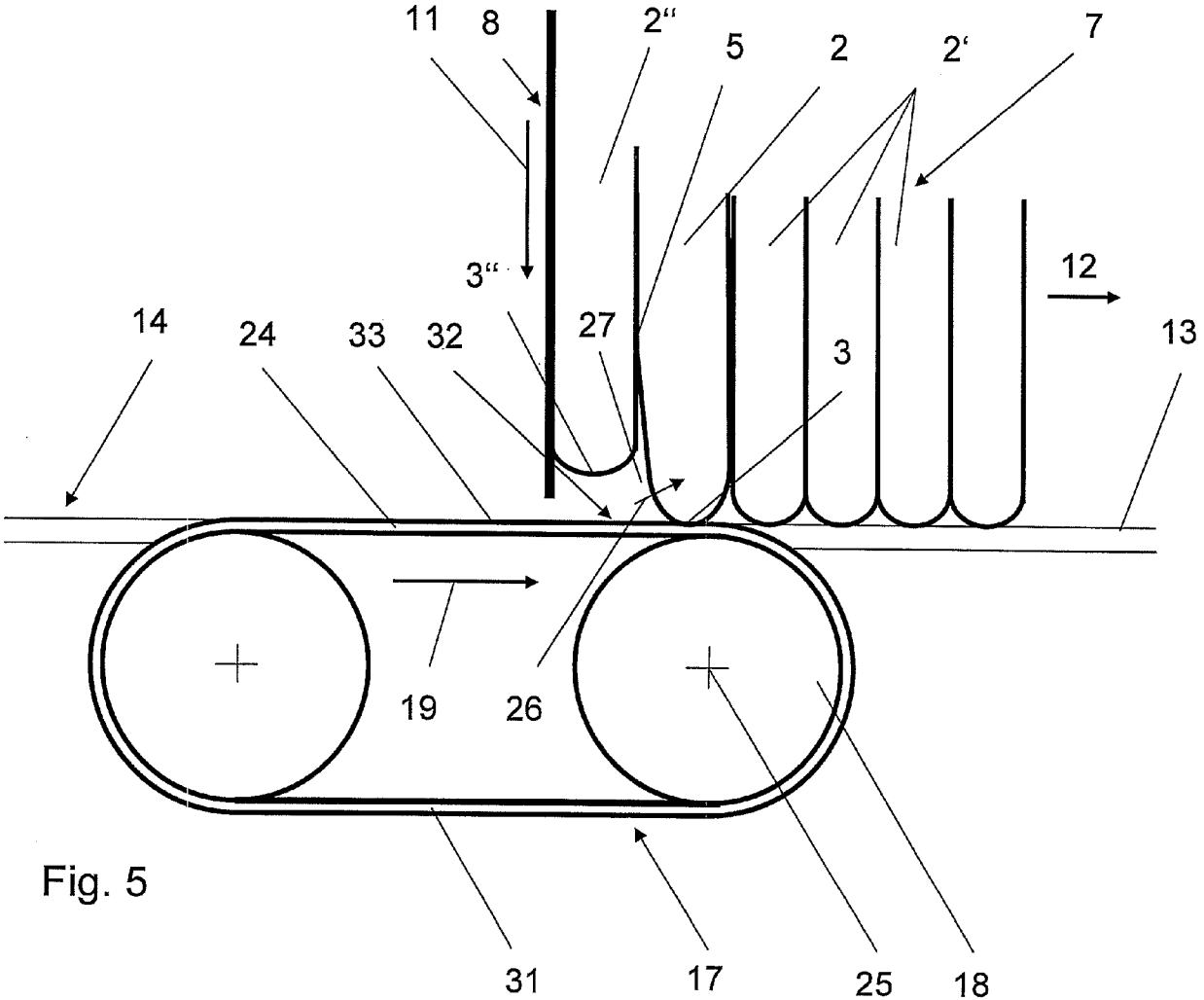
FIG. 5 is an enlarged partial view of components of the device similar to FIG. 4, according to another embodiment of the invention.

A third conveying device 16 is furthermore positioned in the machine frame 22 which comprises two endlessly circulating conveying elements 17 that are spaced apart and are embodied as toothed belts in this case. FIG. 2 shows that the conveying elements are arranged between the two forward-feed belts 15 and comprise respectively an upper belt section 24 as well as a lower belt section 31 (FIG. 3). Once the lower edge 3 of the respective printed product 2 impacts with the stack support 13, the printed product is acted upon by the endlessly circulating conveying elements 17 of the third conveying device 16, which are arranged in an impact area 32 for the printed products 2. As shown in FIGS. 3 to 5, the conveying elements 17 are respectively fitted around a deflection element 18, rotating around an axis 25 and embodied as a deflection roller, which element is arranged downstream of the area of impact 32 between the printed products 2 and the stack support 13. The conveying elements 17 are driven by a motor, not shown herein, and are tensioned with the aid of a tensioning device 23. The drive is connected to a control unit, also not shown herein, so that the speed of the conveying elements 17 can be varied. The deflection element 18 can furthermore be displaceable in horizontal and vertical direction. Of course, the third conveying device 16 can also be provided with a single conveying element 17, which in that case may be embodied particularly wide, or can be provided with more than two spaced-apart conveying elements 17. As shown in FIGS. 3 to 5, the third conveying device 16 is arranged in a region upstream to downstream of the area of impact 32 for the printed products 2 on the stack support 13 and can effectively support the conveying operation in this impact area 32, in addition to the forward-feed belts 15 of the second conveying device 14. Thus, for the operation of the third conveying device, this device must consequently be arranged in the area of impact 32 for the printed products 2 on the stack support 13.

According to FIG. 4, each conveying element 17 includes a plurality of pusher elements 20 that are embodied as teeth or fingers, with respectively a gap 21 in-between. FIG. 4 shows a movement direction 19 for the upper belt section 24. The gaps 21 between the pusher elements 20 are dimensioned such that they can respectively accommodate a lower edge 3 of the printed product 2. The speed of the conveying elements 17 in movement direction 19 is adjusted such that the pusher elements 20 of the upper belt section 24 horizontally move at a speed, for example, equal to or greater than the forward-feed speed of the stack 7. As a result, a pusher element 20 acts upon the respective printed product 2 arriving on the stack support 13, along the back 5 in the lower edge 3 region, such that the product is moved and/or pushed with its lower edge 3 against the stack 7, wherein this operation is explained further in the following.

FIG. 4 shows a printed product 2 which impacts with its lower edge 3 with the conveying elements 17 of the third conveying device 16 and, simultaneously, also impacts with the second conveying device 14 as well as the stack support 13. Furthermore shown are a plurality of printed products 2' that precede the printed product 2 and form the stack 7, as well as a printed product 2" that trails the printed product 2 and moves in transporting direction 11 toward the third conveying device 16 and/or its conveying elements 17. Since the conveying elements 17 are driven continuously and the speed of the pusher elements 20 corresponds at least to the forward-feed speed of the second conveying device 14, the printed product 2 is acted upon by a pusher element 20 along the back 5 in the region of the lower edge 3 and is pushed toward the right, meaning toward the stack 7, as indicated by the leading printed products 2'. The pusher element 20 has already acted upon the lower edge 3 of the printed product 2 along the back side 5 and has deflected it in the direction of arrow 26 toward the stack 7. An intermediate space 27 is thus created between the two lower edges 3, 3" of the successively following printed products 2, 2".

As a result of the intermediate space 27, created in this way, the friction between the printed products 2, 2" is reduced, so that these can be stacked more securely and more carefully. Following the deflection of the edge 3 in the direction of the stack 7, the pusher element 20 moves downward and thus leaves the intermediate space 27 as well as the horizontal plane of the stack support 13.

The above-explained operation takes place for each printed product 2, 2', 2". However, an embodiment is also conceivable in principle where the third conveying device 16 only acts upon some of the printed products 2, 2', 2", for example each second or third printed product.

The third conveying device 16 can be embodied to be adjustable, such that it can be moved to a retracted position in which it does not pick up the printed products 2. The conveying elements 17 can be replaced for the adaptation to different printed products 2. For particularly thick printed products 2, conveying elements 17 having especially wide gaps 21 are used. For comparatively narrow printed products 2, the teeth can be closer together. The pusher elements 20 can be produced from a suitable plastic material and can be embodied such that the printed products 2 are not damaged along the lower edge 3 during the displacement.

According to another embodiment, the third conveying device 16 comprises at least one conveying element 17 (FIG. 5) which is embodied as a flat belt. The flat belt has a rough surface 33 and is composed either of a material that frictionally acts upon the printed products 2 in the region of the lower edge 3, for example rubber, or is at least provided with such a surface, for example a rubber-coated surface. In addition to the forward-feed belts 15 of the second conveying device 14, this conveying element 17 which conveys the printed products 2 exclusively with the aid of friction, effectively functions to convey the printed products 2 in the area of impact 32 with the stack support 13.

It will be understood that the above description of the present invention is susceptible to various modifications, changes and adaptations, and the same are intended to be comprehended within the meaning and range of equivalents of the appended claims.

What is claimed is:

1. A method to produce stacks composed of printed products, comprising:

supplying the printed products substantially vertically and in an overlapping flow with the aid of a first conveying device continuously to an essentially horizontally extending stack support;

forming a stack at the stack support, wherein the printed products are at least approximately lined up in an upright position;

transporting the stack on the stack support with a second conveying device moving at a forward-feed speed and in a forward-feed direction, wherein the stack is supported along a leading stack end against a support device that also moves in the forward-feed direction; and acting upon a region of a lower edge of at least one printed product in an area of impact of the printed product, which simultaneously impacts the stack support and the second conveying device, using a third conveying device to move the lower edge of the at least one printed product in the forward-feed direction of the stack with a speed that corresponds at least to the forward-feed speed of the stack to thereby create a space between two lower edges of successively following printed products.

2. The method according to claim 1, wherein the acting step includes acting upon the at least one printed product, which impacts the stack support, through at least one of positive engagement or frictionally.

3. The method according to claim 1, wherein the acting step includes acting upon the region of the lower edge of the at least one printed product along a back of the at least one printed product which faces away from the stack.

4. The method according to claim 1, wherein the acting step includes acting upon the region of the lower edge of the at least one printed product by the third conveying device with the aid of a pusher element to push the at least one printed product toward the forming stack.

5. The method according to claim 1, wherein the acting step includes acting upon the region of the lower edge of the at least one printed product by the third conveying device using friction to push the at least one printed product toward the forming stack.

6. A device for producing stacks of printed products, comprising:

a horizontally extending stack support;

a first conveying device to supply the printed products continuously in an overlapping flow and essentially vertically to the stack support, wherein the stack support comprises an area of impact in which a lower edge of the printed products impact with the stack support before forming a stack while positioned upright and lined up on the stack support;

a support device;

a second conveying device, arranged to be impacted by the printed products simultaneously with the impact on the stack support, and adapted to move the stack in a forward-feed direction against the support device, wherein the support device supports the stack along a leading stack end; and a third conveying device that is adapted to act upon the lower edge of the printed products that arrive on the stack support in the area of impact to move the lower edge of the printed products in the forward-feed direction toward the stack with a speed that corresponds at least to the forward-feed speed of the stack to create a space between two lower edges of successive printed products.

7. The device according to claim 6, wherein the third conveying device comprises at least one endlessly circulating conveying element.

8. The device according to claim 7, wherein the at least one endlessly circulating conveying element comprises at least one pusher element.

9. The device according to claim 8, wherein the at least one pusher element is adapted to push a back of the printed products.

10. The device according to claim 8, wherein the at least one pusher element comprises one of a tooth or a finger.

11. The device according to claim 7, wherein the at least one endlessly circulating conveying element engages in the lower edge of the printed products.

12. The device according to claim 7, wherein the at least one endlessly circulating conveying element comprises one of a driven toothed belt or a driven flat belt.

13. The device according to claim 7, further comprising a deflection element that is arranged downstream of the area of impact and around which the at least one endlessly circulating conveying element is fitted.

14. The device according to claim 6, wherein the third conveying device comprises at least two endlessly circulating conveying elements that are arranged at a distance to each other.

* * * * *